US005217092A

United States Patent [19]

Potter

[11] Patent Number: 5,217,092

[45] Date of Patent: Jun. 8, 1993

[54] SELF-BELAY AND DESCENT DEVICE AND METHOD OF ITS USE

[76] Inventor: Steven D. Potter, 54 Brook St., Brookline, Mass. 02146

[21] Appl. No.: 721,290

[22] Filed: Jun. 26, 1991

[51] Int. Cl.[5] ..... B65H 59/14

[52] U.S. Cl. ..... 188/65.4; 188/65.1

[58] Field of Search ..... 188/65.1, 65.2, 65.3, 188/65.4

[56] References Cited

U.S. PATENT DOCUMENTS

| | | | |
|---|---|---|---|
| 316,870 | 4/1885 | Braunfeld | 188/65.4 |
| 3,542,158 | 11/1970 | Arnold | 188/65.4 |
| 3,757,901 | 9/1973 | Hobbs | 188/65.4 |
| 3,876,036 | 4/1975 | Sweet | 182/18 |
| 4,253,218 | 3/1981 | Gibbs | 24/134 |
| 4,334,595 | 6/1982 | Koch | 182/5 |
| 4,531,610 | 6/1985 | Fertier et al. | 182/5 |
| 4,667,772 | 5/1987 | Kammerer | 182/6 |
| 4,678,059 | 7/1987 | Bowker | 188/65.4 |
| 4,723,634 | 2/1988 | Fisk | 188/65.4 |
| 4,877,110 | 10/1989 | Wolner | 182/232 |
| 4,941,548 | 7/1990 | Blanchard | 182/234 |

FOREIGN PATENT DOCUMENTS 0018302 10/1980 European Pat. Off. .

OTHER PUBLICATIONS

"Shunt B03" and Croll B06 advertisements, Petzl.

*Primary Examiner*—Matthew C. Graham

*Attorney, Agent, or Firm*—Celia H. Ketley

[57] ABSTRACT

A self-belaying and descent device is provided which includes a triaxial junction, including a rope wrap leg, a rope deflector leg and a rope clamp leg joined at a central area, and a structure for retaining a rope in a desired configuration around the triaxial junction. This device, when used with one rope configuration, will travel freely up a rope during climbing, but lock securely in place if the climber should fall. When used with an alternate rope configuration, the device allows a climber to safely descend a rope.

16 Claims, 6 Drawing Sheets

SELF-BELAY AND DESCENT DEVICE AND METHOD OF ITS USE

BACKGROUND OF THE INVENTION

The present invention relates to devices which can move freely in one direction along a rope, but which grab securely when loaded in the opposite direction. The device of the invention is useful as a self-belaying device for climbers, and a safety device for industrial applications.

The sport of climbing or mountaineering typically requires a team of two people. To ensure the safety of the climber, the climber ties into a rope (i.e. the rope is tied to a harness worn by the climber), and is belayed by a partner. While the climber ascends, the belayer takes up or lets out the rope such that the rope is maintained taut between the climber and belayer, preventing a fall of any great distance by the climber. One type of belaying system, known as "top-roping", employs an anchor placed at the top of the cliff. Typically, the rope runs through this anchor pulley-fashion and the belayer stands at the foot of the cliff, although in some cases the belayer will belay from the top. In either case, the anchor is above the climber at all times, so that the climber will fall only a short distance if he "falls off" the climb.

This safety system, employed correctly, is generally very effective. However, because a partner is not always available, there has been a need for a device which would protect the safety of the climber in a similar manner without the need for a second person to belay (such a device will be referred to hereinafter as a "self-belay device").

An effective self-belay device would also be advantageous in safeguarding workers who are required to climb on the job, for example carpenters, roofers and the like.

An effective self-belay device would be one which would slide freely up a rope which is anchored at the top of a cliff or building, but lock securely in place when loaded downward, e.g., if the climber should fall.

One type of device which has been tried for use as a self-belay device is an "ascender". These devices are intended for use in climbing a fixed rope, in situations in which it is preferable to climb the rope rather than the rock or ice cliff. In order to climb a fixed rope, a pair of ascenders is attached to the rope, and the climber ascends by moving one ascender at a time up the rope, and stepping up into a stirrup attached to that ascender. In this use, the ascender is relatively safe, as it is easy for the climber to ascertain whether the ascender will properly grab the rope before the climber commits his weight to the device, and if the ascender does not grab, the clamping mechanism can then be hand assisted. Further, the use of two ascenders allows the load to be transferred from one to the other gently, and the direction of the load is continuously, rather than suddenly, downward. However, for a number of reasons, this device is highly unsafe when used as a self-belay device in a free-climbing situation, i.e. when the climber is climbing the rock itself. For example, the downward load when the climber falls is sudden and may be many times the climber's weight; the orientation of the climber is unpredictable; it is critical that the device immediately grab; and loops of slack rope may form if the rope does not feed properly through the device.

Further, ascenders typically require moving parts, which increases the possibility of mechanical failure and jamming of the device with, e.g., snow, dirt and corrosion. Also, these devices typically utilize camming devices to lock the device against the rope, the teeth of which may become worn due to friction from the rope in a self-belay situation, causing them to become polished and not grab the rope during a fall.

Two devices have been manufactured specifically for use as self-belay devices. One, sold by Petzl under the tradename "SHUNT", is used primarily as a back-up safety device for rappeling (descending an anchored rope). The other, sold by Rock Exotica, under the tradename "SOLOIST", is used as a self-belay device for free climbing. Both devices, however, suffer from many of the same disadvantages as ascenders, for example moving parts, camming parts which place a high localized stress on the rope during a fall, and sensitivity to rope diameter. Most importantly, the "Soloist" device may fail to hold a fall if the orientation of the climber with respect to the rope anchor is such that the rope does not properly torque the camming device, while the "Shunt" device may inadvertantly be pulled down the rope, instead of locking in place, if it is improperly loaded during a fall.

Additionally, all of the above-mentioned devices are sensitive to rope diameter, and can only be used safely with ropes of diameters of from 9 to 11 mm.

A further deficiency of the prior art devices is the difficulty of descending the rope after having fallen while climbing a building or cliff. It is necessary when using such devices to attach a separate rappel device in order to descend, which is generally awkward and difficult due to the load on the self-belay device.

Thus, it has been desired in the climbing field, to provide a self-belay device which would be safe in a variety of climbing situations, would be free from moving parts, could be used with any diameter rope and could easily be used to descend the rope.

SUMMARY OF THE INVENTION

The present invention provides a self-belay device which comprises a triaxial junction, consisting essentially of a rope wrap leg, a rope deflector leg and a rope clamp leg joined at a central area; and a means for retaining a rope in a desired configuration around the triaxial junction. Preferably, the device further comprises a means for attaching the device to a harness and a means for keeping the device in an upright position during use. Used with one rope configuration, for example a knot known in the art as a "Munter Hitch" and illustrated in the accompanying figures, this device travels freely up a fixed rope while a climber ascends, but locks securely in place on the rope during a fall. By moving the rope to an alternate configuration, the climber can use the device to safely descend the rope. The use of the three-legged triaxial junction allows the device to move smoothly on a rope, without kinking or other damage to the rope.

In its method aspects, the present invention relates to a method of self-belaying which comprises the steps of providing a device of the invention, and wrapping a rope around the triaxial junction of the device such that the device will move up the rope, but will lock in place on the rope when loaded in a downward direction. The invention further relates to a method of descending a fixed rope, having an anchored end and a free end, which comprises the steps of providing a device of the invention and wrapping the rope around the triaxial junction of the device such that the device will travel down the rope when it is subjected to the weight of the climber, and the rate of descent will be controlled, as in a conventional rappel, by controlling the tension on the free end of the rope.

DETAILED DESCRIPTION OF THE INVENTION

Figure 1:
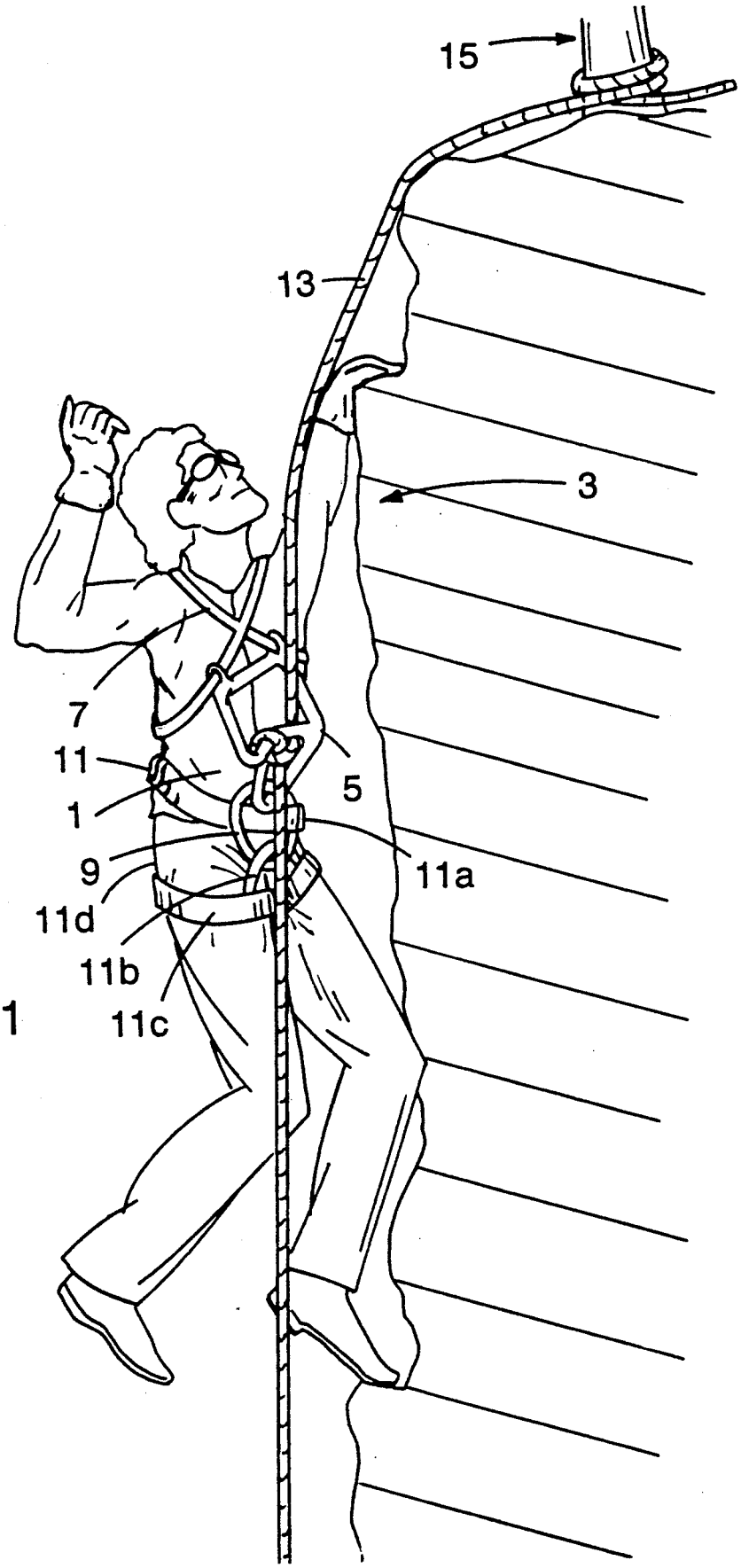
FIG. 1 is a schematic view of a climber ascending a cliff using a device according to one embodiment of the invention.

Preferred embodiments of the invention will be described in further detail hereinbelow with reference to the accompanying drawings, in which like reference numerals refer to like parts. The following discussion is intended to be illustrative and not limiting in effect.

In FIG. 1, a climber 1 is shown climbing a cliff 3, using a self-belay device 5 of the invention. The device is attached to the climber's harness 11 (which comprises waist loop 11*a*, center loop 11*b*, leg loops 11*c* and rear loop 11*d*) by carabiner 9. The device of the invention is supported in an upright position, such that it does not trail below the climber, by chest harness 7. A rope 13, fixed at the top of the cliff by anchor 15, runs through device 5 in the "climbing mode" configuration, as will be explained below. Rope 13 may be lightly weighted at its lower end, if desired, causing the rope to travel more readily through device 5.

Figure 2:
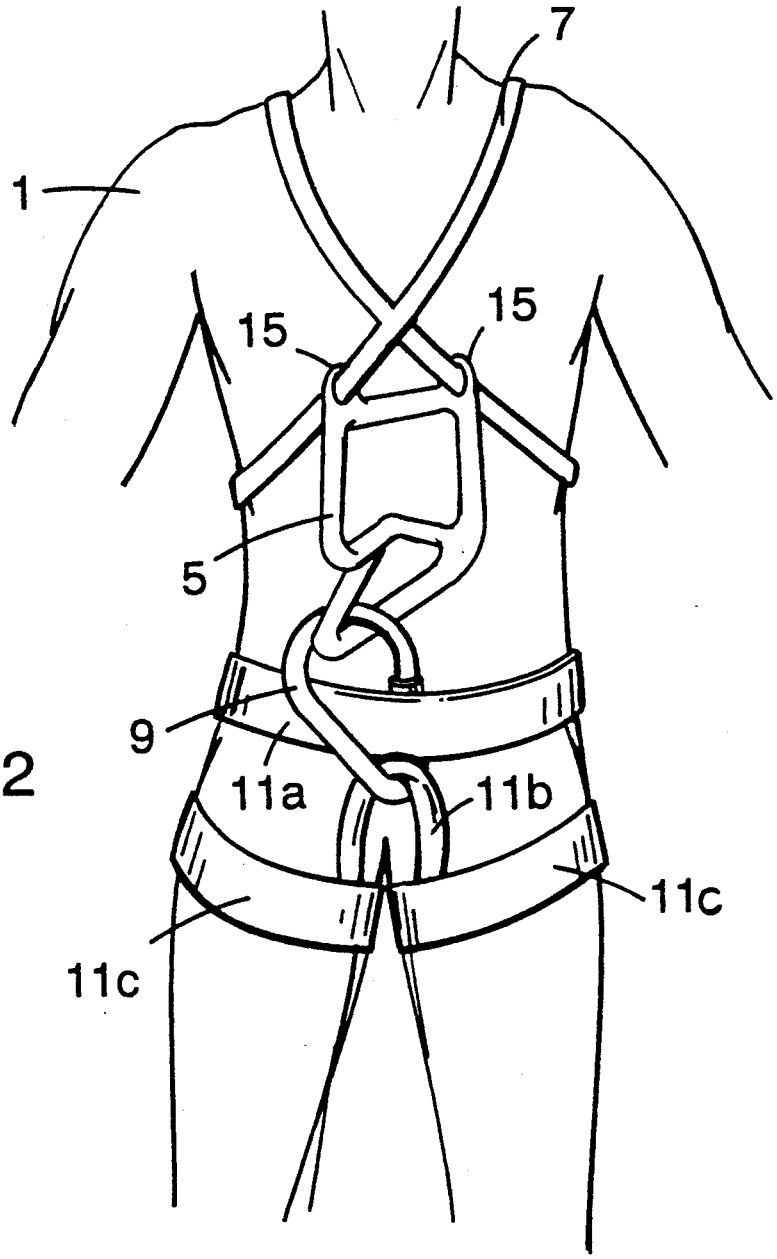
FIG. 2 is a fragmentary, enlarged front view of the climber shown in FIG. 1, showing the attachment of the device of the invention to the climber's harness.

Preferred means for attaching the device to a climber's harness, and maintaining the device in an upright position are illustrated in FIG. 2. The device is securely fastened to harness 11, worn by climber 1, by carabiner 9 (a gated metal ring used in climbing). The carabiner would, when used with the type of harness shown, be passed through center loop 11*b*, waist loop 11*a*, and the lower portion of device 5. The device is maintained in an upright position during use by attachment means 15 (preferably a carabiner or sturdy loop), which attach to the climber's chest harness 7. The above is one preferred arrangement; however, other types of harnesses, attachment means, and means of maintaining the device in an upright position may be utilized, provided that the device is attached to the climber securely enough to withstand the force of a fall, and maintained in a position in which it will function safely. The device of the invention may be used with any combination of conventional chest and waist harnesses, including simple harnesses which are formed from, e.g., knotted nylon webbing.

Figure 3:
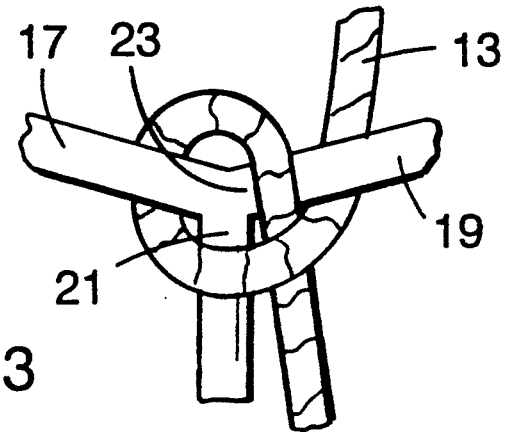
FIG. 3 is a fragmentary perspective view of the triaxial junction which is fundamental to the device of the invention, with a rope disposed thereon in a configuration suitable for climbing (climbing mode).

FIG. 3 shows a simplified, fragmentary view of the triaxial junction which is present in every embodiment of the invention, with a rope 13 disposed thereon in "climbing mode". The triaxial junction comprises rope wrap leg 17, rope deflector leg 19 and rope clamp leg 21, joined at a central area 23. In each embodiment of the invention, the combination of the three legs, joined at a central area, enables a rope to be maintained in the configuration shown, known in the art as a Munter Hitch, during climbing. This configuration allows the device to travel smoothly up the rope during climbing, but immediately and securely lock in place during a fall. The same combination (the triaxial junction), when used with an alternate rope configuration, explained hereinbelow, can be used to descend the rope in a controlled manner, known in the art as rappelling.

Figure 4A:
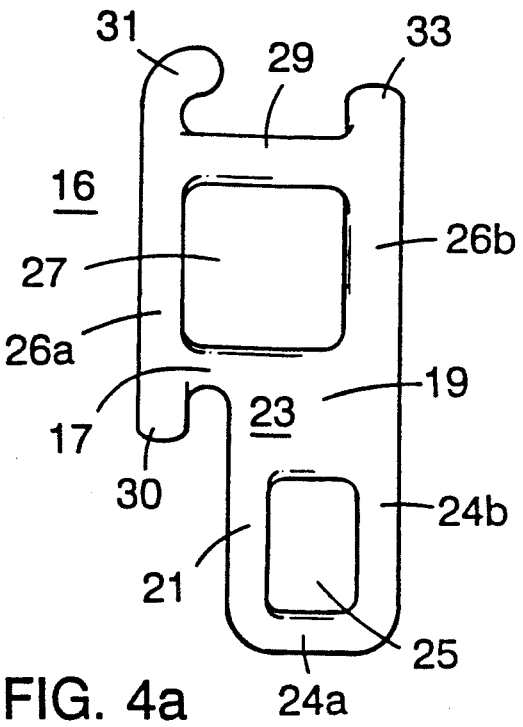
FIGS. 4(*a*), 4(*b*), and 4(*c*) are front views of a device according to one embodiment of the invention, (a) without a rope, showing the triaxial junction, (b) with a rope wrapped thereon in climbing mode, and (c) with a rope wrapped thereon in descent mode.
Figure 4B:
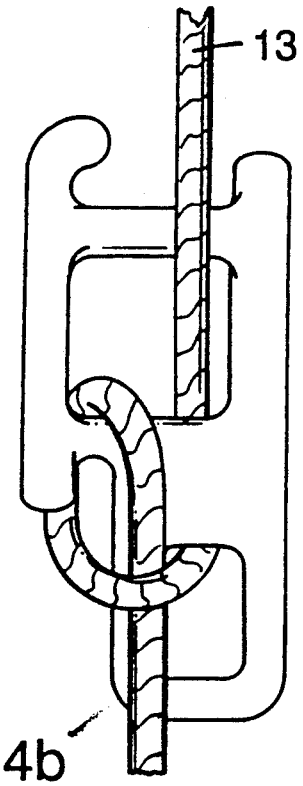
Figure 4C:
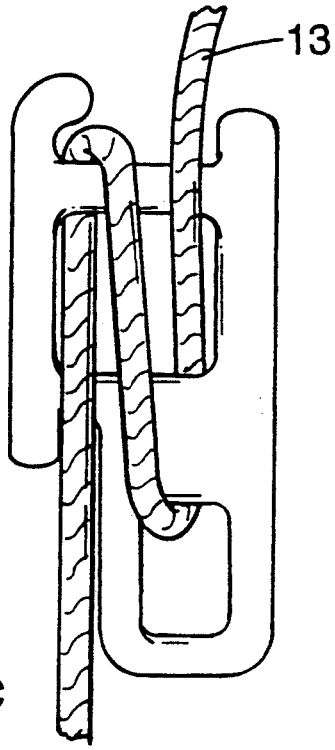

A device 16, according to one embodiment of the invention, is shown in FIG. 4. This device is approximately flat, and is thus easy to manufacture, transport and store. This device illustrates that the central area formed by the junction of the three legs need not be a well-defined point, but may be an area or even another, joining, leg.

The device shown in FIG. 4 comprises the three legs, 17, 19 and 21 and central area 23 which are fundamental to the invention. The device further comprises two enclosed open areas 27 and 25, defined by legs 26*a*, 26*b* and 29, and 21, 24*a* and 24*b*, respectively. When the device is used, the rope is fed through these open areas in the desired configuration, and retained by the legs which define areas 27 and 25. Although a closed configuration, such as that shown, is preferred for maximum safety, the rope may be adequately maintained in position by disposing a leg between the rope wrap leg and deflector legs only, forming a single enclosed open area, e.g. open area 27 in FIG. 4.

In FIG. 4(*b*), device 16 is shown with rope 13 wrapped thereon in climbing mode, i.e. in a Munter Hitch around the triaxial junction. When the device is in climbing mode, rope 13 hangs from the device downward while the climber ascends, and moves freely up the rope. As mentioned above, if desired, a light weight, such as the climber's pack, may be attached to the lower end of the rope to cause the rope to run more readily through the device.

In FIG. 4(*c*), the device is shown with rope 13 wrapped thereon in rappel (descent) mode. In this configuration, the rope is further held in the desired position by upper rappel restraint 31 and lower rappel restraint 30. Although not critical to the function of the device, the two rappel restraints increase the control and thus safety obtainable from the device during descent. When the device is in rappel mode, the climber may safely descend the rope by allowing the lower end of the rope to slide through his hand such that the tension on the rope is reduced and the device moves in a controlled fashion down the rope. As in a rappel with a conventional device, the climber can stop his descent entirely by grasping the free end firmly. Shoulder 33, not shown in the other figures, is an optional element, provided to keep the rope away from the gating means in embodiments in which one is provided.

FIG. 4(*c*) shows one preferred configuration which may be used for rappelling. This configuration is preferred because it minimizes damage to the rope, e.g. kinking. However, many other configurations may be used, as long as they provide the same function, i.e. allow the climber to safely descend the rope by controlling the tension on the free end of the rope.

A device according to this embodiment of the invention could be attached to a climber's chest harness by two loops or carabiners fastened through the upper corners of opening 27, and to the climber's waist harness by a carabiner or similar attachment means fastened through opening 25. Other, alternate attachment means could be used, provided safety requirements are met, as discussed hereinabove.

Figure 5:
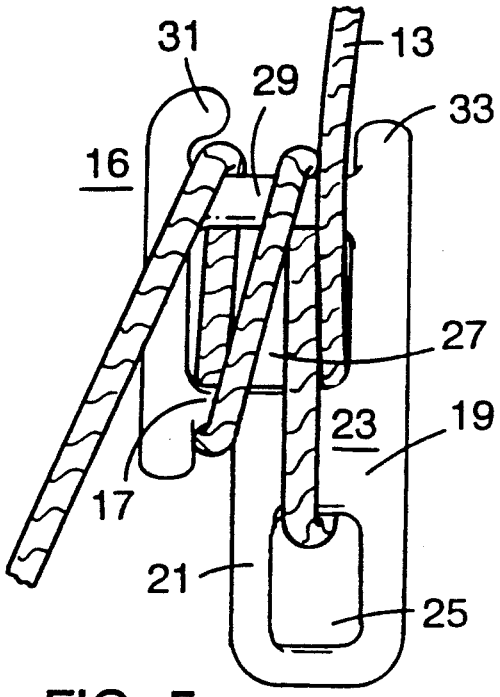
FIG. 5 is a front view of the device shown in FIG. 4, showing an alternate rope configuration for use in descending.

FIG. 5 illustrates an alternate rope configuration which may be used when device 16 is in descent mode. This configuration will create more friction during rappelling, due to the additional rope wrap. The device may thus be used safely with small diameter ropes, increasing its versatility. Other devices of the invention may be similarly used by wrapping the rope a second time around the triaxial junction as shown.

Figure 6A:
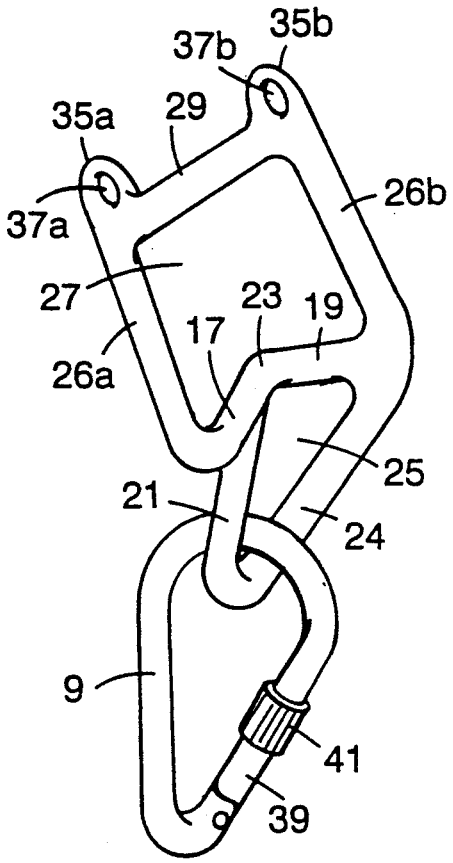
FIGS. 6(*a*), 6(*b*), and 6(*c*) are perspective views of a device according to an alternate embodiment of the invention, shown with and without a rope, as in FIG. 4.
Figure 6B:
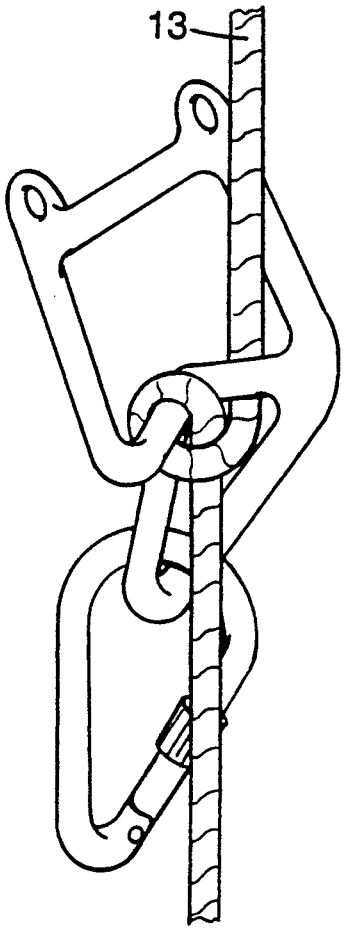
Figure 6C:
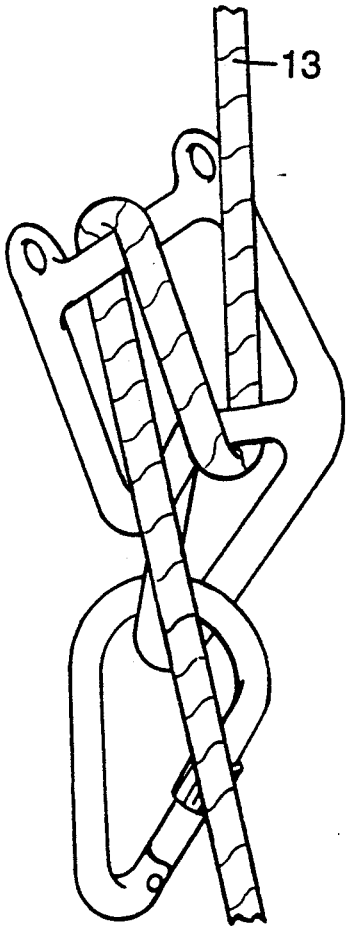

An alternate embodiment of the invention is shown in FIG. 6. In this embodiment, the device is not planar, i.e. the three legs which comprise the triaxial junction are not in a single plane. This embodiment, and other non-planar embodiments, are generally preferred, because the angle formed between the three legs tends to make the device move more freely up the rope, and minimizes kinking of the rope. The optimal angle between the rope wrap and rope deflector legs is from about 60 to 80 degrees, and preferably about 70 degrees, while the optimal angle between the rope wrap leg and a vertical axis through the device is about 90 degrees.

The device shown in FIG. 6 comprises essentially the same elements as the device shown in FIG. 4, arranged in the non-planar configuration. In the device of FIG. 6, rappel restraints are provided by ears 35*a* and 35*b*, which also adapted to receive means for attaching the device to a chest harness through openings 37*a* and 37*b*. FIG. 6 also shows a carabiner 9 disposed through opening 25, for attachment to a climber's waist harness. This carabiner is preferably provided with locking means 41 to secure gate 39 in a closed position during use, for added safety. FIG. 6 (*b*) and (*c*) shows the device in climbing and descent mode, as described above in connection with FIG. 4.

Figure 7A:
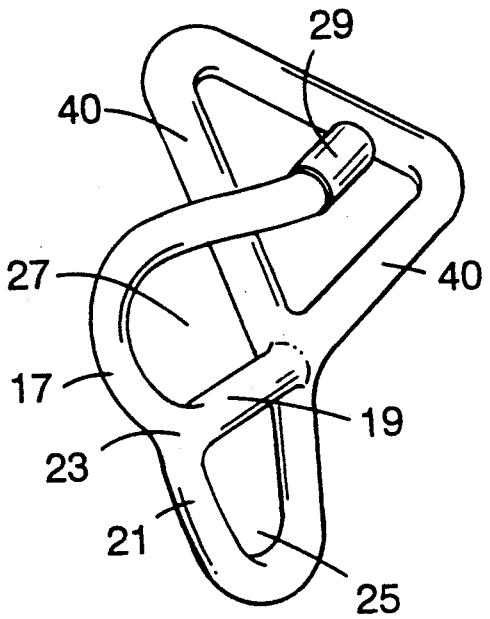
FIGS. 7(*a*), 7(*b*), and 7(*c*) are perspective views of a device according to another embodiment of the invention, shown with and without a rope, as in FIG. 4.
Figure 7B:
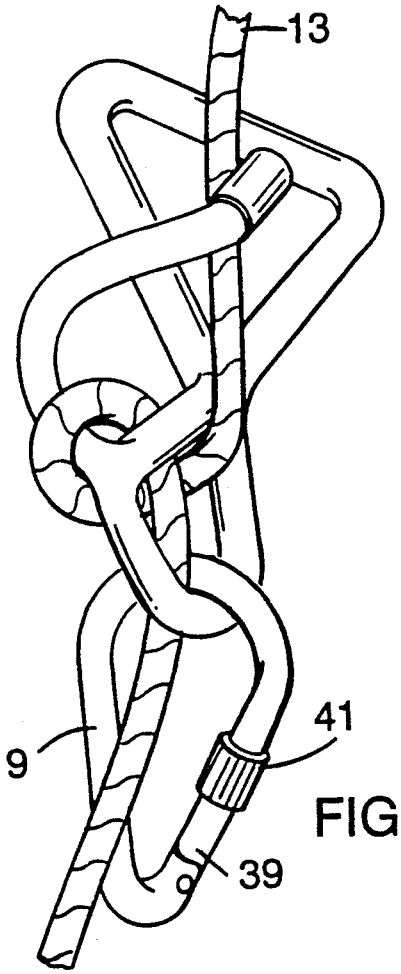
Figure 7C:
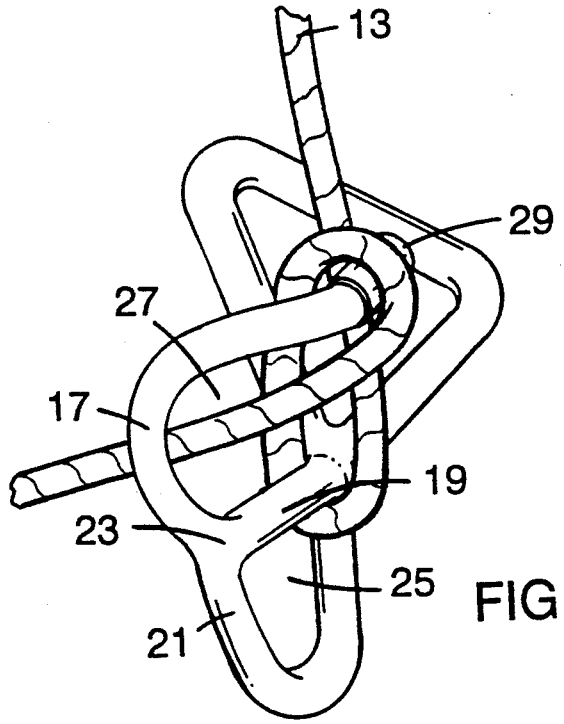

FIG. 7 shows yet another embodiment of the invention. In this embodiment, the advantageous non-planar configuration is provided, while also providing a relatively flat back surface 40. This flat back allows the device to rest comfortably against the climber's chest during use. Additionally, this configuration may be easily provided with a gating means (discussed further hereinbelow, with reference to FIG. 9), and also the climber may shift from climbing mode to rappel mode without unfastening the device from his chest harness.

This embodiment comprises many of the same elements as the basic embodiment shown in FIG. 4, disposed similarly with respect to each other but arranged in a different spatial configuration. The device is shown in climbing and rappel mode in FIG. 7 (*b*) and (*c*).

Figure 8:
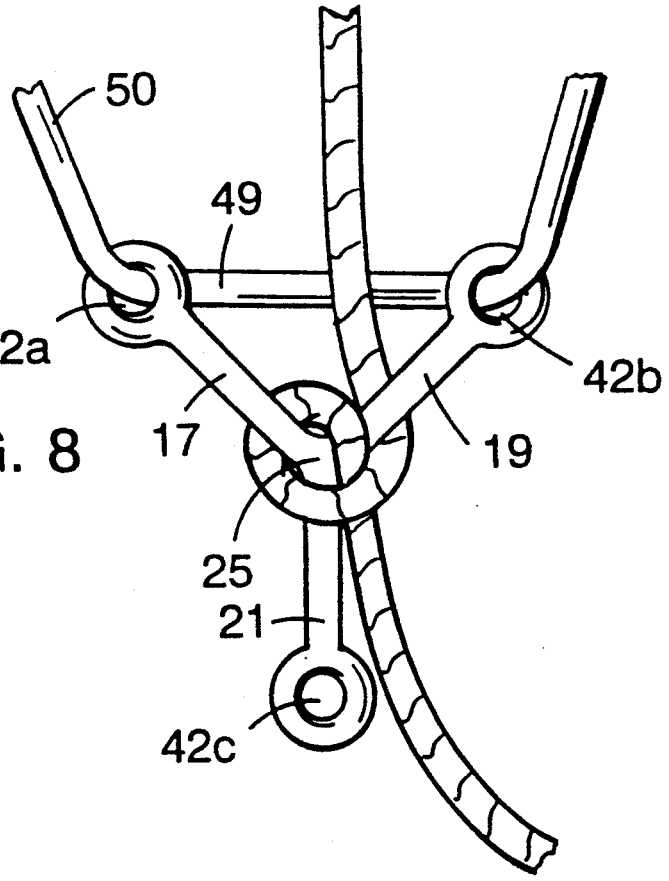
FIG. 8 is a front view of a device according to an embodiment of the invention in which slings are used as the rope retaining means.

An alternate means for retaining the rope in the desired configuration, and also maintaining the device in an upright position is shown in FIG. 8. In this embodiment of the invention, a very simple device is provided, comprising only the triaxial junction, comprised of the three legs 17, 19 and 21 joined at central area 23. Two openings in legs 17 and 19 allow attachment means 50, typically a length of webbing, cord or the like, to be threaded across the top of the two legs. This attachment means may be formed from the webbing of the chest harness itself, thus allowing for a very simple and lightweight device. Attachment means 50 thus, in area 49, takes the place of leg 29 in the two above-described embodiments. An opening 42*c* in leg 21 is provided such that the device may be attached to the climber's waist harness. Other, similar configurations may also be provided, e.g. the webbing may be threaded through all three legs for added stability.

Figure 9:
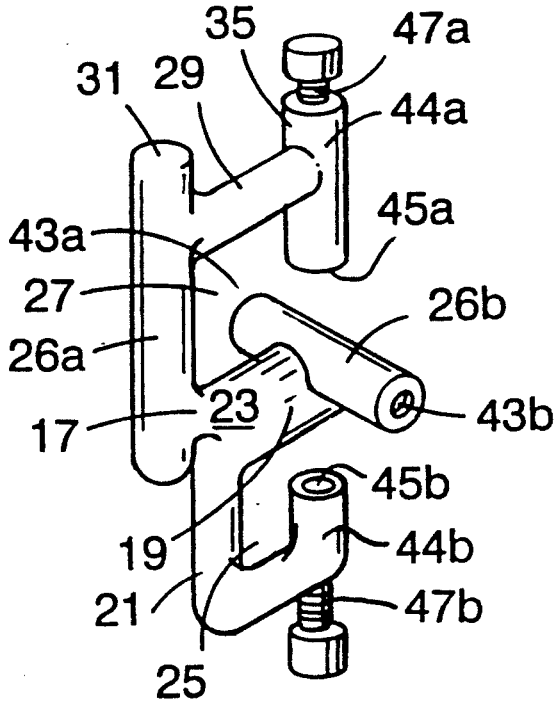
FIG. 9 is a perspective view of a device of the invention which further comprises a gating means to allow easier wrapping of the rope about the triaxial junction.

FIG. 9 shows one of many possible ways in which the device of the invention could be gated, in order to allow the rope to be more easily wrapped around the triaxial junction. In the device shown in FIG. 9, which is otherwise similar to that shown in FIG. 4, leg 26*a* is a rotatable gate having threaded apertures 43*a* and 43*b* at its ends. Threaded bolts 47*a* and 47*b* are screwed through apertures 45*a* and 45*b* in members 44*a* and 44*b*, allowing the gate to be secured in the closed position during use and opened to allow wrapping/unwrapping of the rope around the triaxial junction.

A variation to the above-described embodiments may be provided, wherein the device does not comprise an upper rappel restraint, and the rappel bar is slanted, such that if the climber lets go of the rope while descending in rappel mode the rope will be flipped back into a Munter Hitch. (The direction of slant will typically be downward from the side corresponding to the rope deflector leg to the side corresponding to the rope wrap leg.) This embodiment provides a "fail-safe" rappel, as the Munter Hitch will cause the device to lock in place on the rope, rather than sliding down the rope as it otherwise would if the climber let go during a rappel.

The device of the invention may be fabricated of any material having sufficient strength and rigidity to withstand the forces generated during a climber's fall. For adequate safety, it is preferred that the device be able to withstand greater than about 3000 pounds when tested using conventional methods such as those used to test carabiners. Preferred materials are metals, including but not limited to chrome-molybdenum steel, stainless steel, titanium, and aluminum, copper, magnesium, zinc and titanium alloys. Particularly preferred are high strength aluminum alloys, e.g. 7075-T6. However, due to the design of the device, relatively low strength metals, such as aluminum casting alloy 220-T4, would have adequate strength when used in the device. The strength of the device will also depend upon the manufacturing process used; thus, if a low strength metal is to be used, it is preferred that the device be made by a process which will provide optimal strength. In addition to metals, other materials having similar strength and physical properties may be used, e.g. composites, provided the strength of the device is adequate. One suitable composite material is graphite filled nylon, which is advantageous from a processing standpoint, as it may be injection molded.

Most conventional manufacturing processes can be used in the manufacture of the device. Such processes include, but are not limited to, forging, die casting, investment casting and molding. The device may also be assembled from separate elements, e.g. by welding or bolting together. The preferred process for manufacturing a device of the invention will depend upon the configuration of the device (non-planar devices may not have a parting line suitable for use in some operations), and considerations of cost and efficiency. Forging and investment casting are preferred for high strength.

In addition to its application as a self-belay and descent device for free climbing, the device of the invention may also be used advantageously as the lower ascender when paired ascenders are used to climb a fixed rope, as discussed hereinabove.

Preferred embodiments of the invention have been discussed in detail hereinabove. Many other variations and modifications may be practiced, however, without departing from the spirit and scope of the invention. The following example is intended to be illustrative and not limiting in its effect.

EXAMPLE

Devices were made according to the embodiments shown in FIGS. 6 and 7. The devices were made from Al Alloy 319, using a sand casting process. Each device was tested for strength by loading it along its vertical axis, and withstood a load of greater than 2000 lbs. The devices were then field tested under top-rope conditions (an anchor was set up at the top of the cliff). The devices performed well in both climbing and rappel mode. Both devices locked securely during falls, allowed smooth rope feed during climbing, and provided a smooth, safe rappel descent.

What is claimed is:

1. A self-belaying and descent device for use by a climber, through which a rope, having a free end and a fixed end, may be threaded, comprising:

a) a triaxial junction comprising a rope wrap leg, a rope deflector leg and a rope clamp leg joined at a central area; and b) a means for retaining the rope in a munter hitch configuration about the triaxial junction, said configuration causing the rope to pass, from the fixed end toward the free end, around the rope wrap leg, and through the loop formed by the rope as it passes around the rope wrap leg so that the fixed and free ends of the rope are substantially parallel and extend in opposite directions from the rope wrap leg;

said triaxial junction being dimensioned and arranged to maintain the munter hitch in a position in which the free end will be clamped by the fixed end when the fixed end is loaded, but will not be clamped when the fixed end is not loaded, thereby allowing the device to move along the rope with minimal friction in one direction relative to the rope, and lock relative to the rope when the device is loaded in the opposite direction.

2. A device of claim 1 further comprising a means for attaching the device to a waist harness.

3. A device of claim 2 further comprising a means for attaching the device to a chest harness.

4. A device of claim 1 wherein the rope wrap leg, rope deflector leg and rope clamp leg are approximately planar.

5. A device of claim 1 wherein the rope wrap leg, rope deflector leg and rope clamp leg are non-planar.

6. A device of claim 5 wherein the angle between the rope wrap leg and rope deflector leg is from about 60 to about 80 degrees.

7. A device of claim 1 wherein the triaxial junction is formed from a structural material selected from the group consisting of chrome-molybdenum steel, stainless steel, titanium, aluminum, copper, magnesium, zinc and titanium alloys and composites.

8. A device of claim 1 wherein the triaxial junction is formed from graphite filled nylon.

9. A device of claim 1 wherein the means for retaining a rope in said configuration comprises a leg which connects the rope wrap leg and rope deflector such that an enclosed opening is formed between the three legs.

10. A device of claim 1 wherein the means for retaining a rope in said configuration comprises a length of webbing which is threaded through openings in the rope wrap leg and rope deflector leg such that an enclosed opening is formed between the two legs and the webbing.

11. A device of claim 10 wherein the webbing is part of a chest harness.

12. A device of claim 1 wherein the device is formed from a forged metal.

13. A device of claim 1 wherein the device is formed from a cast metal.

14. A device of claim 1 wherein the device is formed from an injection molded composite material.

15. A method of self-belaying for use by a climber which comprises the steps of:

a) providing a device through which a rope, having a fixed end and a free end, may be threaded, said device comprising:

i) a triaxial junction comprising a rope wrap leg, a rope deflector leg and a rope clamp leg joined at a central area; and ii) a means for retaining a rope in a munter hitch configuration about the triaxial junction; and b) wrapping a rope around the triaxial junction of the device, such that the rope passes, from the fixed end toward the free end, around the rope wrap leg, and through the loop formed by the rope as it passes around the rope wrap leg so that the fixed and free ends of the rope are substantially parallel and extend in opposite directions from the rope wrap leg, said triaxial junction being dimensioned and arranged to maintain the munter hitch in a position in which the free end will be clamped by the fixed end when the fixed end is loaded, but will not be clamped when the fixed end is not loaded, thereby allowing the device to move along the rope with minimal friction in one direction relative to the rope, and lock relative to the rope when the device is loaded in the opposite direction.

16. The method of claim 15 further comprising the step of descending the fixed rope, by flipping the munter hitch over, without removing the rope from the device, such that the device will travel down the rope when it is subjected to the weight of the climber, and the rate of descent will be controlled by controlling the tension on the free end of the rope.

* * * * *